United States Patent [19]

Kral et al.

[11] 4,403,575

[45] Sep. 13, 1983

[54] DEVICE FOR PREVENTING FLASHING TO STEAM IN AN ECONOMIZER OF A FLOW THROUGH STEAM GENERATOR

[75] Inventors: Rudolf Kral, Langensendelbach; Reiner Engelhardt, Effeltrich, both of Fed. Rep. of Germany

[73] Assignee: Kraftwerk Union Aktiengesellschaft, Mülheim an der Ruhr, Fed. Rep. of Germany

[21] Appl. No.: 293,884

[22] Filed: Aug. 18, 1981

[30] Foreign Application Priority Data

Aug. 28, 1980 [DE] Fed. Rep. of Germany ..... 3032507
Jul. 3, 1981 [DE] Fed. Rep. of Germany ..... 3126321

[51] Int. Cl.[3] ..... F22D 5/26

[52] U.S. Cl. ..... 122/451.1; 122/20 B; 122/420; 122/479 D; 122/480

[58] Field of Search ..... 122/420, 451.1, 1 R, 122/1 C, 20 B, 1 A, 1 B, 479 D, 480

[56] References Cited

U.S. PATENT DOCUMENTS 1,098,902 6/1914 Holden ..... 122/20 B
2,064,444 12/1936 Masshart et al. ..... 122/1 R
2,594,471 4/1952 Marshall ..... 122/1 A

FOREIGN PATENT DOCUMENTS 128440 7/1948 Australia ..... 122/1 R
1751965 8/1968 Fed. Rep. of Germany .
1004139 9/1965 United Kingdom .
1333980 10/1973 United Kingdom .

*Primary Examiner*—Edward G. Favors
*Attorney, Agent, or Firm*—Laurence A. Greenberg; Herbert L. Lerner

[57] ABSTRACT

Device for preventing flashing to steam in an economizer of a flow-through steam generator wherein the economizer has heating surfaces disposed downstream of an evaporator and superheater surfaces in direction of a flue-gas path, including at least one partition separating the cross section of the flue-gas path in vicinity of the economizer into at least two joint areas separated from one another, the economizer having tubes disposed only in one of the thus formed joint areas, and further including shut-off devices for the flue-gas disposed upstream of the tubes of the economizer as viewed in the direction of the flue-gas path.

4 Claims, 1 Drawing Figure

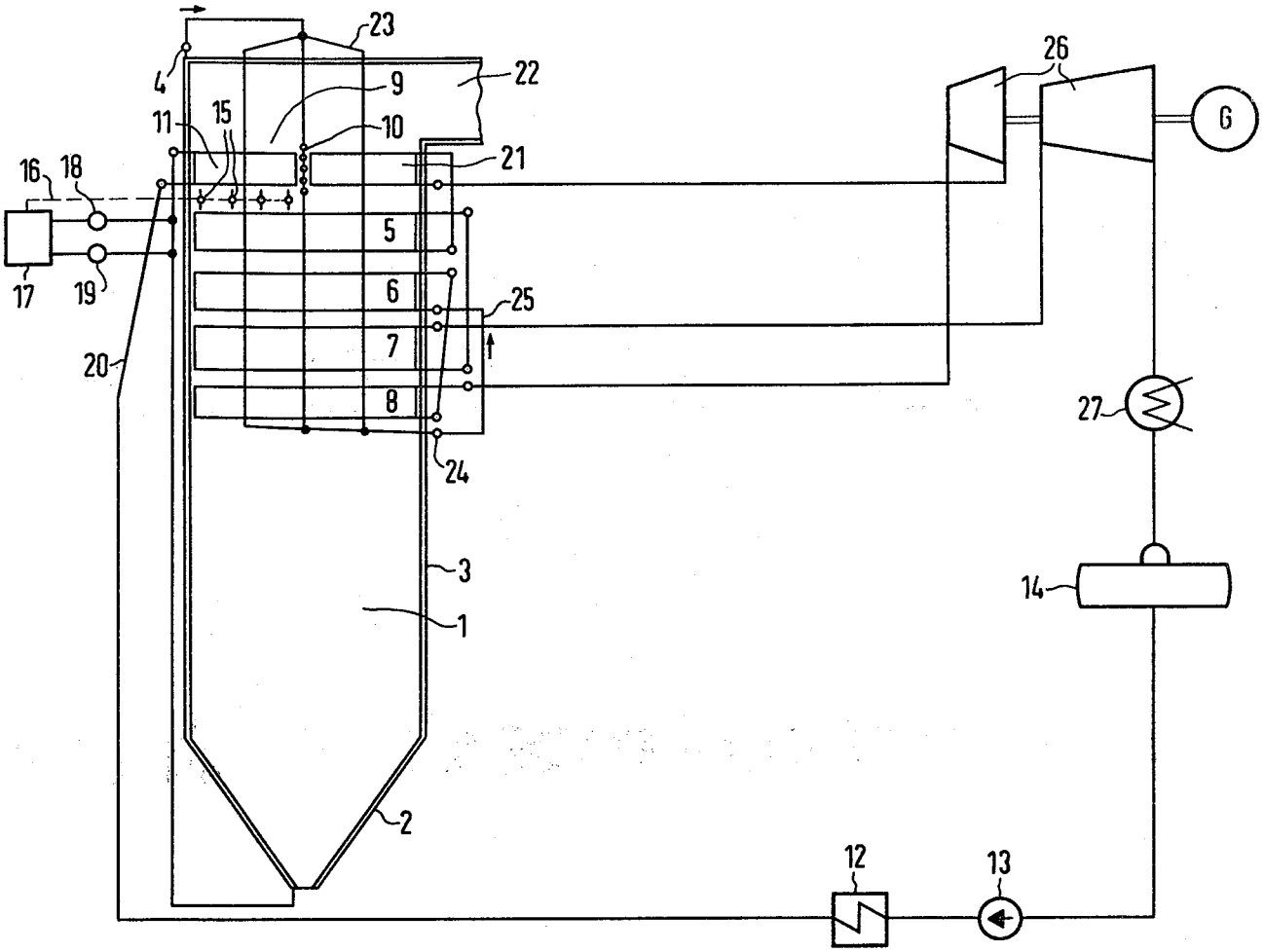
G
26
27
14
13
12
22
21
25
24
3
1
2
23
9
10
5
6
7
8
15
11
4
20
18
19
16
17

DEVICE FOR PREVENTING FLASHING TO STEAM IN AN ECONOMIZER OF A FLOW THROUGH STEAM GENERATOR

The invention relates to a device for preventing flashing to steam in an economizer of a flow-through steam generator wherein the economizer heating surfaces are disposed downstream of an evaporator and superheater surfaces in flue-gas direction.

To start a steam generator, it is known, for example, from German Published Prosecuted Application (DE-AS) No. 1 751 965, to introduce to the economizer an increased quantity of feedwater via a bypass-line to the evaporator heating surfaces. In such a connection, any steam which may possibly be present in the tubes of the economizer will be thrust out therefrom.

Furthermore, it is known, for example, from British Pat. No. 1,333,980 that, in waste heat boilers of gas turbines, slide control valves be disposed upstream and downstream of the tubes of the waste heat boiler and, selectively, the waste-gas flow of the gas turbine be used to heat up the water in the waste heat boiler or be conducted past the latter.

British Pat. No. 1,004,139 shows another device with slide control valves located upstream of waste heat exchangers in the waste-gas line of a gas turbine and with by-pass lines disposed therebetween.

In contrast with these heretofore known devices, it is an object of the invention of the instant application to provide, a flow-through steam generator with an economizer heating surface disposed downstream of superheater heating surfaces, as viewed in flue-gas direction, which ensures that when the flow-through steam generator is shut down or when there is a sharp reduction in the load of the flow-through steam generator, flashing to steam in the economizer is prevented. Such flashing or vaporization can occur, for example, due to heat radiation from the preceding superheater or evaporator heating surfaces connected thereto or also due to heating of the tubes of the economizer by heated air or flue gas.

With the foregoing and other objects in view there is provided, in accordance with the invention, a device for preventing flashing to steam in an economizer of a flow-through steam generator wherein the economizer has heating surfaces disposed downstream of an evaporator and superheater surfaces in direction of a flue-gas path, comprising at least one partition separating the cross section of the flue-gas path in vicinity of the economizer into at least two joint areas separated from one another, the economizer having tubes disposed only in one of the thus formed joint areas, and further comprising shut-off devices for the flue gas disposed upstream of the tubes of the economizer as viewed in the direction of the flue-gas path.

In accordance with another feature of the invention, the other of the joint areas is provided with tubes of other heating surfaces in a multistage steam turbine connected to the steam generator.

In accordance with a further feature of the invention, the other heating surfaces are comprised of an intermediate superheater.

In accordance with an additional feature of the invention, the device includes control means. For the shut-off devices depending upon pressure and temperature of water in the tubes of the economizer, the shut-off devices being closable by the control means if danger of flashing to steam exists in the economizer.

In accordance with a concommitant feature of the invention, the shut-off devices are disposed upstream of the partition as viewed in the direction of the flue-gas path.

Other features which are considered as characteristic for the invention are set forth in the appended claims.

Although the invention is illustrated and described herein as embodied in device for preventing flashing to steam in an economizer of a flow-through steam generator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the single FIGURE of the drawing which is a schematic diagram of a system embodying the device of the invention.

Referring now to the drawing, there is shown therein a flow-through or once-through steam generator for coal-firing having a combustion chamber 1 with a hopper or funnel 2 as well as gas-tightly welded tube walls 3 which define the combustion chamber 1. Flue gases rise upwardly from the combustion chamber 1 and reach the ambient air through a second draft 22. The tube walls 3 are formed of evaporator tubes gas-tightly welded to one another, wherein water, preheated in preheaters and heated until nearly boiling temperature in an economizer 11 disposed in the flue-gas draft, is evaporated.

The generated steam is exhausted from the tube walls 3 and collected in headers 4.

In the illustrated embodiment of the drawing, the tubes of a partition or dividing wall 10 is after-connected to the headers 4. Support tubes 23 parallel to the tubes of the partition 10, are traversed by steam. The tubes of the partition 10 extend downwardly from the lower edge of the partition 10, likewise as support tubes, and terminate together with the support tubes 23 in a support-tube outlet header 24. The latter is connected via a line 25 with the inlet of a superheater heating surface. A superheater heating surface 8 is after-connected to the superheater heating surface 6 and is, in turn, further connected to a turbine 26 to which the steam is conducted. Intermediate superheater heating surfaces 21, 5 and 7 are connected between the high and low pressure stages of the turbine 26. Condensate then flows, after purifying and preheating, if desirable or necessary, into a feedwater container 14 and, via a feed-pump to high-pressure preheaters 12 and then is delivered to the economizer 11.

The partition 10 divides the cross section 9 for the flue-gas path into two somewhat equally large joint areas. In the one joint area located at the left-hand side of the partition 10 in the FIGURE, the tubes of the economizer 11 are located. Shut-off devices 15 constructed as turnable flaps are provided between the tubes of the economizer 11 and the intermediate superheater heating surface 5 disposed upstream thereof in the flue-gas path, the shut-off devices 15 being driven via a linkage 16 by a control system 17. The latter is operative, dependend upon a temperature measuring device 18 and a pressure measuring device 19, both of which are connected to a connecting line 20, between the economizer and the hopper or funnel 2 of the steam generator and, accordingly detect or establish the pressure and temperature of the water discharging from the economizer 11. From these values, the control system 17 determines if the condition of the water leaving the economizer is approaching too closely to the vaporization point, and then closes the shut-off devices 15.

In the illustrated embodiment of the figure, the tubes of the intermediate superheater 21 are disposed in the other joint area of the cross section 9 formed by the partition 10, that other joint area being at the right-hand side of the partition 10 in the FIGURE.

It is also possible to provide several joint areas for the cross section 9 by having several partitions of dividing walls 10, however, only one of these joint areas may be filled with the tubes of the economizer 11. Moreover, the joint area filled with the tubes of the intermediate superheater 21 in the illustrated embodiment may remain empty. In such a case this joint area would be provided with a smaller cross section and, additionally, shut-off devices would then be provided for closing off this joint area which would then be acting as a by-pass.

Advantageously, the shut-off devices 15 are disposed upstream of the partition 10, as viewed in flue-gas flow direction, so that, when the shut-off devices 15 are largely or entirely closed, this partition 10 cannot form any stagnation space wherein gas circulation due to connection would form which would otherwise apply an impermissably high load to the heating surfaces 5 to 8 located in such a stagnation space.

There are claimed:

1. Device for preventing flashing to steam in an economizer of a flow-through steam generator wherein the economizer has heating surfaces disposed downstream of an evaporator and superheater surfaces in direction of a flue-gas path, comprising at least one partition separating the cross section of the flue-gas path in vicinity of the economizer into at least two joint areas separated from one another, the economizer having tubes disposed only in one of the thus formed joint areas, and further comprising shut-off devices for the flue gas disposed upstream of said tubes of the economizer as viewed in the direction of the flue-gas path and control means for said shut-off devices depending upon pressure and temperature of water in the tubes of the economizer, said shut-off devices being closable by said control means if danger of flashing to steam exists in the economizer.

2. Device according to claim 1 wherein the other of the joint areas is provided with tubes of other heating surfaces in a multi-stage steam turbine connected to the steam generator.

3. Device according to claim 2 wherein said other heating surfaces are comprised of an intermediate superheater.

4. Device according to claim 1 wherein said shut-off devices are disposed upstream of said partition as viewed in the direction of the flue-gas path.

* * * * *